US008273975B2

(12) United States Patent
Gisler et al.

(10) Patent No.: US 8,273,975 B2
(45) Date of Patent: Sep. 25, 2012

(54) FLUTE

(76) Inventors: Barbara Gisler, Vienna (AT); Werner Tomasi, Vienna (AT)

( * ) Notice: Subject to any disclaimer, the term of this patent is extended or adjusted under 35 U.S.C. 154(b) by 88 days.

(21) Appl. No.: 12/871,211

(22) Filed: Aug. 30, 2010

(65) Prior Publication Data

US 2012/0048094 A1 Mar. 1, 2012

(51) Int. Cl.
*G10D 7/02* (2006.01)

(52) U.S. Cl. ..... 84/384

(58) Field of Classification Search ..... 84/384
See application file for complete search history.

(56) References Cited

U.S. PATENT DOCUMENTS

| | | | | |
|---|---|---|---|---|
| 17,054 | A * | 4/1857 | Pfaff | 84/384 |
| 444,830 | A * | 1/1891 | Guenther | 84/384 |
| 920,471 | A * | 5/1909 | Jenner | 84/384 |
| 2012/0048094 | A1 * | 3/2012 | Gisler et al. | 84/384 |

FOREIGN PATENT DOCUMENTS

| | | | |
|---|---|---|---|
| BE | 1012659 | A7 | 2/2001 |
| CN | 201035955 | Y * | 3/2008 |
| CN | 201518217 | U * | 6/2010 |
| DE | 49789 | C | 11/1889 |
| DE | 9317027 | U1 | 4/1994 |
| DE | 29907789 | U1 | 7/1999 |
| FR | 624703 | A | 7/1927 |
| JP | 56123395 | A | 9/1981 |
| KR | 20080104949 | A | 12/2008 |

OTHER PUBLICATIONS

Machine Translation of Cheong-San Lee or also spelled Qingshan Li cited on the IDS by the second spelling and under publication No. KR20080104949-A.*

Image of the Flute Head Joint by Yamaha YFL-225S, viewed Feb. 8, 2012, manufactured and widely marketed 1980-2000 by Yamaha.*

* cited by examiner

*Primary Examiner* — David Warren
*Assistant Examiner* — Robert W Horn
(74) *Attorney, Agent, or Firm* — Rabin & Berdo, P.C.

(57) ABSTRACT

A flute has a pipe. The pipe has a linear body tube and a linear mouthpiece tube. The body tube has multiple keys for changing the pitch of the flute. The mouthpiece tube is connected to the body tube and has a mouthpiece plate. A curved tube is mounted on one end of the mouthpiece tube facing the body tube. The curved tube, mouthpiece tube and body tube are aligned with one another.

12 Claims, 5 Drawing Sheets

FLUTE

BACKGROUND OF THE INVENTION

1. Field of the Invention

The present invention relates to a flute, and more particularly to a flute that has a linear body tube and a mouthpiece tube. The linear body tube has multiple keys for changing the pitch. The mouthpiece tube has a mouthpiece plate and is connected to the linear body tube having the keys.

2. Description of Related Art

A conventional flute has a mouthpiece tube directly connected to a body tube mounted with keys. Because the pitch performed by the flute must be limited and defined in a precise frequency range, an interval between a mouthpiece plate and keys activated during blowing the flute need to be sufficiently large. For flute players with adult figures, they can adjust their arms to an optimal gesture to correspond to the interval between the mouthpiece plate and the keys and comfortably operate the flute. They do not need to employ a gesture that obstructs the operation of fingers and causes tiredness while operating the flute. Also, adult-figured flute players do not have to put they heads in an unnatural position, which could cause fatigue. However, for flute players without adult figures, especially children, the interval between the mouthpiece plate and the keys activated to change the pitch during blowing the flute are too large and cause various defects. The gesture over expanding the arms hinds the dexterity of fingers and easily causes tension and stiffness of shoulders and spine, which affects the results of practice and learning and damages the bones. To reduce the interval between the mouthpiece plate and keys used to change the pitch, someone suggests bending the mouthpiece tube for 180 degrees. However, the aforementioned suggestion deviates the mouthpiece plate from a geometric axis of the body tube that are mounted with keys, so that a flute player cannot stably hold the flute and cannot study the timbre of the flute. Also, specific fingerings learned by operating the bent flute are useless when the flute player is playing a conventional flute with a linear mouthpiece tube. Furthermore, it is difficult for the player familiar with the bent flute to adapt himself/herself to fingerings of a conventional flute with a linear mouthpiece tube.

To overcome the shortcomings, the present invention provides a flute to mitigate or obviate the aforementioned problems.

SUMMARY OF THE INVENTION

The main objective of the invention is to provide a flute that has a linear body tube and a mouthpiece tube. The linear body tube has multiple keys for changing the pitch. The mouthpiece tube has a mouthpiece plate and is connected to the linear body tube having the keys.

A flute in accordance with the present invention has a pipe and the pipe has a linear body tube and a linear mouthpiece tube. The body tube has multiple keys for changing the pitch of the flute. The mouthpiece tube is connected to the body tube and has a mouthpiece plate. A curved tube is mounted on one end of the mouthpiece tube facing the body tube. The curved tube, mouthpiece tube and body tube are aligned with one another.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
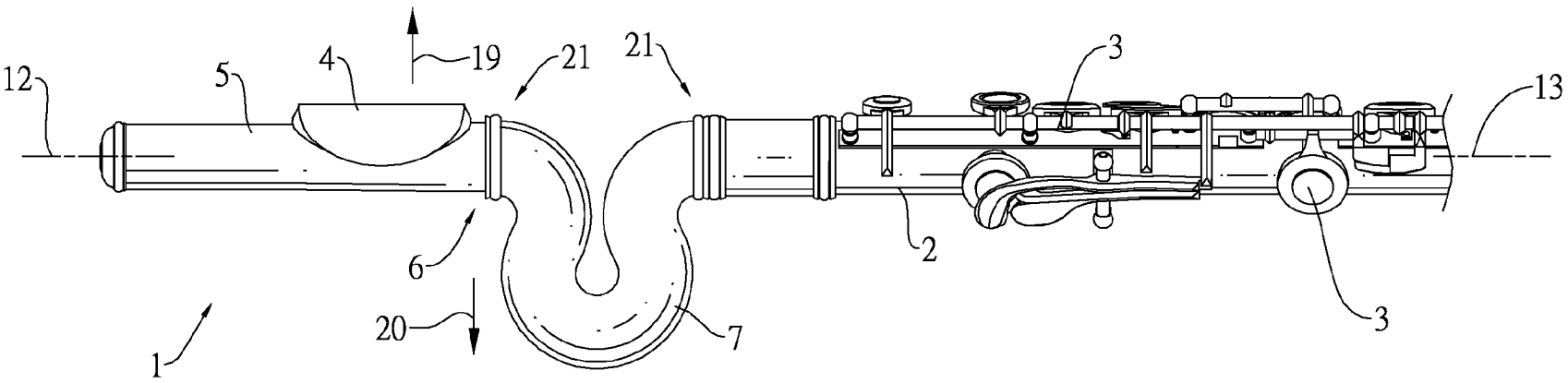
FIG. 1 is a side view of a first embodiment of a flute in accordance with the present invention.
Figure 2:
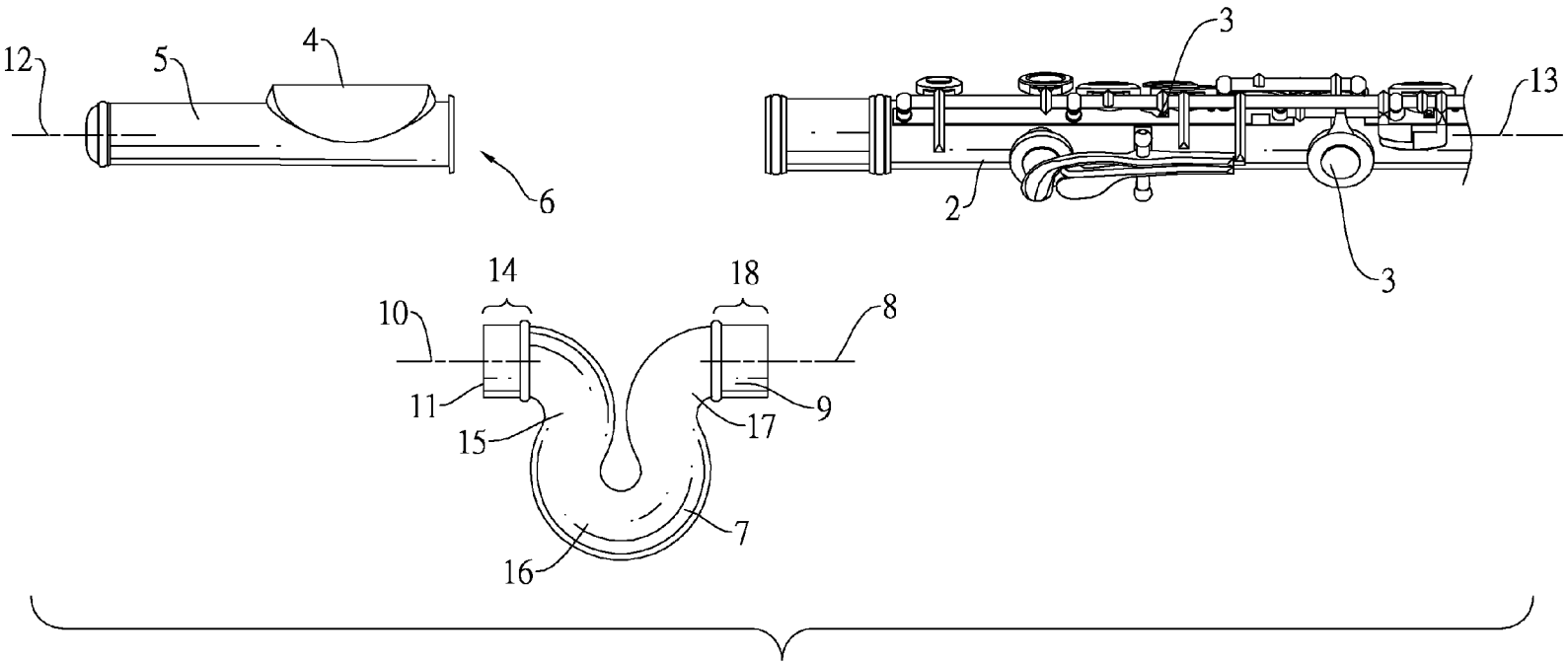
FIG. 2 is an exploded side view of the flute in FIG. 1.

With reference to FIGS. 1 and 2, a first embodiment of a flute in accordance with the present invention comprises a pipe.

The pipe has a body tube (2), a mouthpiece tube (5) and a curved tube (7).

The body tube (2) is linear and has multiple keys (3) mounted on the body tube (2) for changing the pitch of the flute.

The mouthpiece tube (5) is linear and is connected to the body tube (2) and has an outside end, an inside end and a mouthpiece plate (4). The inside end is defined opposite to the outside end and protrudes toward the body tube (2). The mouthpiece plate (4) is mounted on the mouthpiece tube (5).

The curved tube (7) is mounted on the inside end of the mouthpiece tube (5) and has a first end (11) and a second end (9). The first end (11) defines and has a first geometric axis (10) along which the curved tube (7) extends. The second end defines and has a second geometric axis (8) along which the curved tube (7) extends. The first and second geometric axes (10, 8) are aligned with each other. The first end (11) of the curved tube (7) faces and is engaged tightly with the mouthpiece tube (5) mounted with the mouthpiece plate (4). The second end (9) of the curved tube (7) faces and is engaged tightly with the body tube (2) mounted with the keys (3). The aforementioned engagement aligns a mouthpiece-tube-geometric axis (12) of the mouthpiece tube (5) and a body-tube-geometric axis (13) of the body tube (2).

With reference to FIG. 2, the first end (11) of the curved tube (7) has a first section (14) protruding along the first geometric axis (10) from the first end (11) and engaged with the mouthpiece tube (5). The second end (9) of the curved tube (7) has a second section (18) protruding along the second geometric axis (8) from the second end (11) and engaged with the body tube (2). The curved tube (7) has a first curved section (15), a reverse curved section (16) and a second curved section (17). The first curved section (15) is formed on the first section (14) and is curved outward. The reversely curved section (16) is formed on the first curved section (15). The second curved section (17) is formed on the reversely curved section (16). The reversely curved section (16) is symmetrical to the first curved section (17) and is connected to the second section (18).

With reference to FIG. 1, when watching the pipe at a location indicated by an arrow (19) (located over the mouthpiece plate (4) and watching the pipe), the curved tube (7) protrudes downward opposite to the mouthpiece plate (4), as shown along the arrow (20).

In the first embodiment, the curved tube (7) is Ω-shaped. The Ω-shaped curved tube (7) effectively reduces the distance between the mouthpiece plate (4) on the mouthpiece tube (5) and the body tube (2) mounted with the keys (3).

Figure 3:
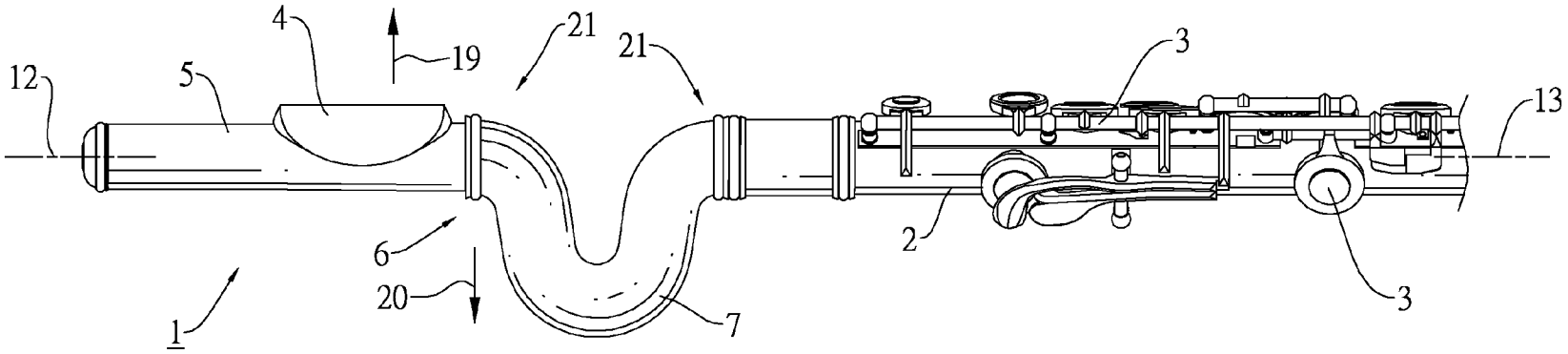
FIG. 3 is a side view of a second embodiment of a flute in accordance with the present invention.
Figure 4:
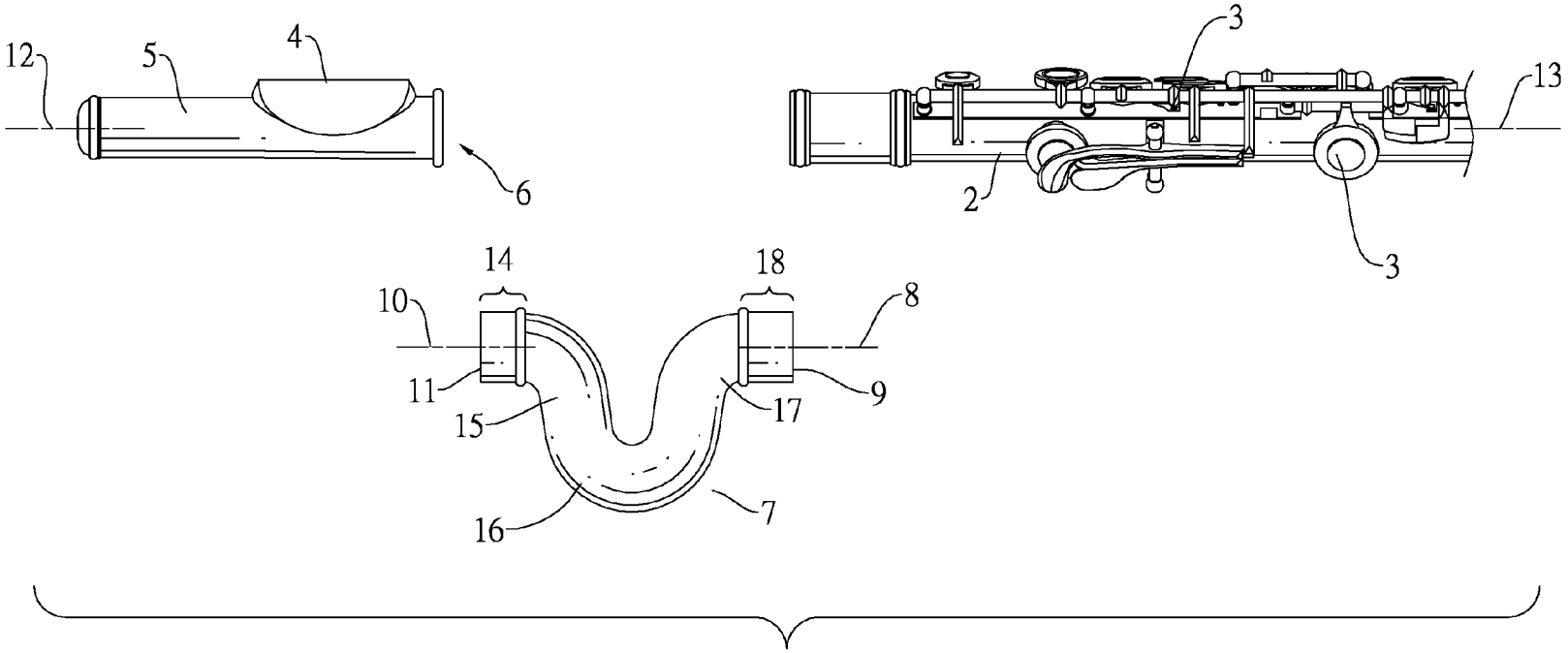
FIG. 4 is an exploded perspective view of the flute in FIG. 3.

With reference to FIGS. 3 and 4, a second embodiment of the flute in accordance with the present invention has the curved tube (7) mounted on one end (6) of the mouthpiece tube (5) facing the body tube (2). One end of the curved tube (7) is engaged with the mouthpiece tube (5) and the other end is engaged with the body tube (2) mounted with the keys (3). The aforementioned structures of the second embodiment are similar to those in the first embodiment shown in FIGS. 1 and 2. The first and second geometric axes (10, 8) extending from the first and second sections (14, 18) are aligned with each other. Because the tight engagement of one end of the curved tube (7) with the mouthpiece tube (5) and the tight engagement of the other end with the body tube (2), the mouthpiece-tube-geometric axis (12) of the mouthpiece tube (5) is aligned with the body-tube-geometric axis (13) of the body tube (2). When located over the mouthpiece plate (4) and watching the pipe, the curved tube (7) protrudes downward opposite to the mouthpiece plate (4), as shown along the arrow (20).

In the second embodiment as shown in FIGS. 3 and 4, the curved tube (7) is U-shaped. The curved tube (7) with such configuration may be manufactured easily. The size of the U-shaped curved tube (7) may be changed in a size range to vary the interval between the mouthpiece plate (4) and the keys (3). The curved tube (7) has a first curved section (15), a reverse curved section (16) and a second curved section (17). The first curved section (15) is formed on the first section (14) and extends outward from the first geometric axis (10). The reversely curved section (16) is formed on the first curved section (15). The second curved section (17) is formed on the reversely curved section (16) and is symmetrical to the first curved section (17) and extends toward the second section (18). The extension of the second section (18) is defined by the second geometric axis (8).

Figure 5:
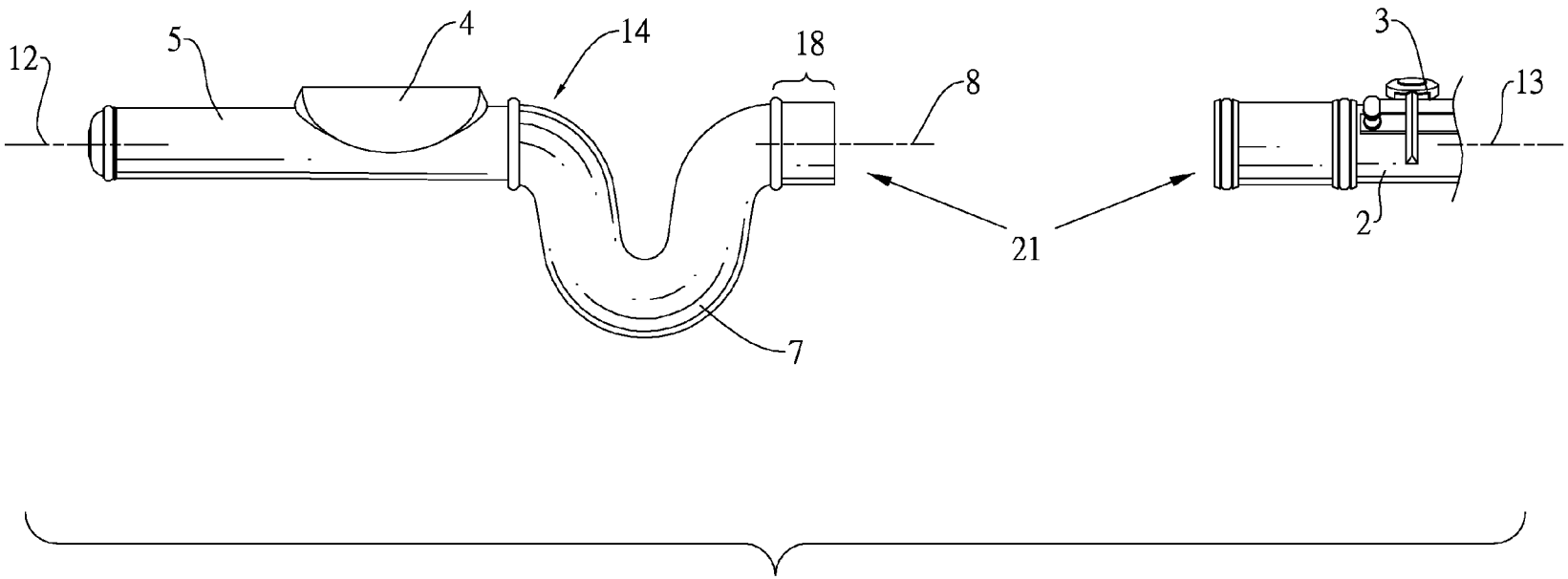
FIG. 5 is a partially exploded side view of a third embodiment of a flute in accordance with the present invention.

In the first and second embodiments as shown in FIGS. 1 to 4, the first and second sections (14, 18) of the curved tube (7) are connected detachably and respectively to the mouthpiece tube (5) and body tube (2) through two plug-and-socket connectors (21). With reference to FIG. 5, a third embodiment of the flute in accordance with the present invention has the first section (14) of the curved tube (7) formed securely on the mouthpiece tube (5). The second section (18) is connected detachably to the body tube (2) through a plug-and-socket connector (21).

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A flute comprising a pipe, and the pipe comprising:

a body tube being linear and having multiple keys mounted on the body tube for changing a pitch of the flute; and a linear mouthpiece tube, connected to the body tube and having an outside end, an inside end defined opposite to the outside end and a mouthpiece plate mounted on the mouthpiece tube;

wherein the flute has an Ω-shaped curved tube mounted on the inside end of the mouthpiece tube, said curved tube having a first end and a second end, the first end defines a first geometric axis, the second end defines a second geometric axis, the first and second geometric axes are aligned with each other, the first end of the curved tube is engaged with the mouthpiece tube, the second end of the curved tube is engaged with the body tube mounted with the keys, and a mouthpiece-tube-geometric axis of the mouthpiece tube is aligned with a body-tube-geometric axis of the body tube.

2. The flute as claimed in claim 1, wherein the first end of the curved tube has a first section protruding along the first geometric axis from the first end and engaged with the mouthpiece tube;

the second end of the curved tube has a second section protruding along the second geometric axis from the second end and engaged with the body tube; and the curved tube has a first curved section formed on the first section and curved outward;

a reversely curved section formed on the first curved section; and a second curved section formed on the reversely curved section, being symmetrical to the first curved section and connected to the second section.

3. The flute as claimed in claim 1, wherein in a view of the pipe taken from over the mouthpiece plate, the curved tube protrudes downward opposite to the mouthpiece plate.

4. The flute as claimed in claim 2, wherein in a view of the pipe taken from over the mouthpiece plate, the curved tube protrudes downward opposite to the mouthpiece plate.

5. The flute as claimed in claim 2, wherein the first and second sections of the curved tube are connected detachably and respectively to the mouthpiece tube and body tube through two plug-and-socket connectors.

6. The flute as claimed in claim 3, wherein the first and second sections of the curved tube are connected detachably and respectively to the mouthpiece tube and body tube through two plug-and-socket connectors.

7. The flute as claimed in claim 4, wherein the first and second sections of the curved tube are connected detachably and respectively to the mouthpiece tube and body tube through two plug-and-socket connectors.

8. The flute as claimed in claim 1, wherein the first and second sections of the curved tube are connected detachably and respectively to the mouthpiece tube and body tube through two plug-and-socket connectors.

9. The flute as claimed in claim 2, wherein the first section of the curved tube is formed securely on the mouthpiece tube and the second section is connected detachably to the body tube through a plug-and-socket connector.

10. The flute as claimed in claim 3, wherein the first section of the curved tube is formed securely on the mouthpiece tube and the second section is connected detachably to the body tube through a plug-and-socket connector.

11. The flute as claimed in claim 4, wherein the first section of the curved tube is formed securely on the mouthpiece tube and the second section is connected detachably to the body tube through a plug-and-socket connector.

12. The flute as claimed in claim 1, wherein the first section of the curved tube is formed securely on the mouthpiece tube and the second section is connected detachably to the body tube through a plug-and-socket connector.

* * * * *